US006112533A

United States Patent [19]

Kato et al.

[11] Patent Number: 6,112,533

[45] Date of Patent: Sep. 5, 2000

[54] FLOW-DOWN ICE MAKER

[75] Inventors: Sonoo Kato; Hatsuo Yamada; Tadashi Sakai, all of Aichi-ken, Japan; Douglas Troy Steward, Newnan, Ga.

[73] Assignee: Hoshizaki Denki Kabushiki Kaisha, Toyoake, Japan

[21] Appl. No.: 09/192,401

[22] Filed: Nov. 16, 1998

[30] Foreign Application Priority Data

Nov. 17, 1997 [JP] Japan ..... 9-315368

[51] Int. Cl.[7] ..... F25C 1/12

[52] U.S. Cl. ..... 62/188; 62/348

[58] Field of Search ..... 62/347, 348, 188

[56] References Cited

U.S. PATENT DOCUMENTS 2,775,100 12/1956 Howe ..... 62/188
3,760,600 9/1973 Matsui et al. ..... 62/348
4,412,429 11/1983 Kohl ..... 62/347
4,934,159 6/1990 Sakai et al. ..... 62/347
5,237,837 8/1993 Naruse et al. ..... 62/347
5,239,836 8/1993 Sakai ..... 62/348

*Primary Examiner*—William E. Tapolcai
*Attorney, Agent, or Firm*—Wenderoth, Lind & Ponack, L.L.P.

[57] ABSTRACT

An ice-making water tank 30, which has a main body 50, is disposed generally below ice-making plates 28. A deep portion 51 of smaller cross-section is formed in the main body 50. The discharge inlet 56 of an overflow pipe 55 is disposed in the central portion of the water surface in the main body 50, and the height of the discharge outlet is set at the upper limit H of the level of the ice-making water. A float switch 57, which sets the lower limit of the water level, is disposed in the central portion of the water surface in the deep portion. Thus, water levels which are almost equal to the prescribed upper limit H and lower limit L can be set even if the ice-making water tank is mounted at an inclined angle.

3 Claims, 6 Drawing Sheets

FLOW-DOWN ICE MAKER

BACKGROUND OF THE INVENTION

1. Field of the Invention

The present invention relates to a flow-down ice maker which produces ice by causing ice-making water to flow over an ice-making plate and cooling the ice-making water by means of an evaporator.

2. Description of the Related Art

FIG. 5 is a diagram showing the internal construction of the conventional flow-down ice maker disclosed in Utility Model No. 60-33182. An ice-making plate 3, over the front surface of which ice-making water flows and to the back surface of which an evaporator 2 is attached, is disposed at an inclined angle within a housing 1 composed of heat-insulating material. A sprinkler 4 is disposed along the top edge of the ice-making plate 3. An ice-making water tank 5 is disposed below the ice-making plate 3. The ice-making water tank 5 is shaped such that its lateral surface area decreases continuously towards the bottom (i.e., the tank is narrower at the bottom than at the top). Ice-making water is supplied to the ice-making water tank 5 from a supply pipe 8, which is provided with a supply valve 7. The ice-making water in the ice-making water tank 5 is conveyed to the sprinkler 4 by a pump 6. A water level detector 9, which detects prescribed upper and lower limits of water level, is disposed in the ice-making water tank 5.

As shown in FIG. 6A, the water level detector 9 comprises: a hollow pipe 10; an annular float 11 with built-in magnets (the flow which is guided by the hollow pipe and rises and falls according to the water level); and a water level upper limit reed switch 12 and water level lower limit reed switch 13. The switches are disposed in the hollow pipe and each open and close depending on the position of the annular float 11. When the water level in the ice-making water tank 5 reaches the upper limit H, the water level upper limit reed switch 12 closes a circuit which closes the supply valve 7 and initiates the ice-making process. The ice-making water then freezes on the ice-making plate 3. When the water level in the ice-making water tank 5 reaches the lower limit L, the water level lower limit reed switch 13 doses a circuit which terminates the ice-making process. In a flow-down ice maker of this type, the amount of ice-making water, which is bounded by the upper limit H and lower limit L of the water level in the ice-making water tank 5, corresponds to the amount of ice produced in one cycle.

However, when the foundation on which the ice maker rests is inclined from front to back or side to side, the housing 1 of the ice maker itself may be inclined from front to back or side to side, and the ice-making water tank 5 may therefore be inclined from front to back or side to side. For example, when the foundation is inclined from front to back with the back being lower, the ice-making water tank 5 is inclined as shown in FIG. 6B. In that case, the water level lines Lx, Mx, Hx, and Nx in FIG. 6B correspond in water volume to the water level lines L, M (a position between water level lines L and H), H, and N (a position above water level line H) in the ice-making water tank 5 when it is horizontal as in FIG. 6A Consequently, for the water level detector 9 to operate at a prescribed water level (i.e., a prescribed water volume), it must be positioned along line Sx, which connects the points of intersection between water level lines L, M, H, and N and water level lines Lx, Mx, Hx, and Nx, respectively. However, because the water level detector 9 is conventionally positioned along line S, which is displaced significantly from line Sx, the water level upper limit reed switch 12 and water level lower limit reed switch 13 are activated above their prescribed positions, at points Nx and Mx, respectively. Furthermore, it should be clear from FIG. 6B that when the position of the water level detector 9 is to the right of line Sx in this drawing, the switches are activated below their respective prescribed positions. Moreover, in the case of this drawing, the shapes of the walls of the ice-making water tank 5 do not change in the vicinity of the upper limit H and lower limit L, and the difference ΔH between Hx and H is therefore almost identical to the difference ΔL between Lx and L. However, if the shapes of the walls of an ice-making water tank change in the vicinity of a given upper limit H and lower limit L, ΔH and ΔL may differ depending on the angle of inclination.

In conventional ice makers, no consideration has been given to the fact that the water level detector 9 may not work properly if the ice-making water tank 5 is inclined due to inclination of the foundation of the ice maker, etc. For that reason, the water level detector 9 is disposed in an arbitrary position, as in FIG. 6B, for example, and the amount of water used to make ice may be affected greatly by the degree of inclination of the foundation. Consequently, conventional ice makers suffer from the problem that the amount of ice-making water per cycle varies depending on the angle of the foundation, and therefore the size of the ice produced is inconsistent from machine to machine.

SUMMARY OF THE INVENTION

The present invention maims to solve the above problems inherent in the conventional technique. An object of the present invention is to provide a flow-down ice maker which is capable of detecting the ice-making water level or allowing the ice-making water level to be set relatively accurately even if the surface of the ice-making water is inclined relative to the apparatus.

Moreover, the position where the amount of water does not vary with respect to a given water level even if the ice-making water tank is inclined has not previously been given a particular name. Thus, in the present specification, this position will therefore be called the "center of the water surface".

The "center of the water surface" will correspond to the geometrical center of a given vessel if the shape of the vessel is symmetrical on about the center of the inclined water surface, but when the vessel is not symmetrical, the "center of the water surface" may differ slightly from the geometrical center of the vessel in question. However, in practice this difference will not be great.

In the present specification, the region where the measurement of the water level is least affected by the inclination of the vessel will be called the "central portion of the water surface" and will be defined as the region which is centered on the "center of the water surface" and includes the geometrical center of the vessel in question.

In order to achieve the above objectives, the invention is a flow-down ice maker, which produces ice by flowing ice-making water from a sprinkler over ice-making plates and cooling the ice-making water by means of an evaporator, characterized in that it comprises: an ice-making water tank for storing ice-making water, comprising a main body provided with a first bottom and a deep portion open to the first bottom, said deep portion provided with a second bottom positioned lower than the first bottom; a pump provided with a water intake disposed in the deep portion of the ice-making water tank for conveying the ice-making water to the sprinkler; a means for setting the upper limit of the water level in the ice-making water tank disposed in a central portion of the water surface in the main body for setting a prescribed upper limit on the water level in the main body; and a means for setting the lower limit of the water level in the ice-making water tank disposed in a central portion of the water surface in the deep portion setting a prescribed lower limit on the water level in the deep portion.

The invention is characterized in that the means for setting the upper limit of the water level in the ice-making water tank is an overflow pipe, which is disposed such that a discharge outlet thereof is positioned facing upwards in the central portion of the water surface in the main body.

DETAILED DESCRIPTION OF THE PREFERRED EMBODIMENTS

Figure 1:
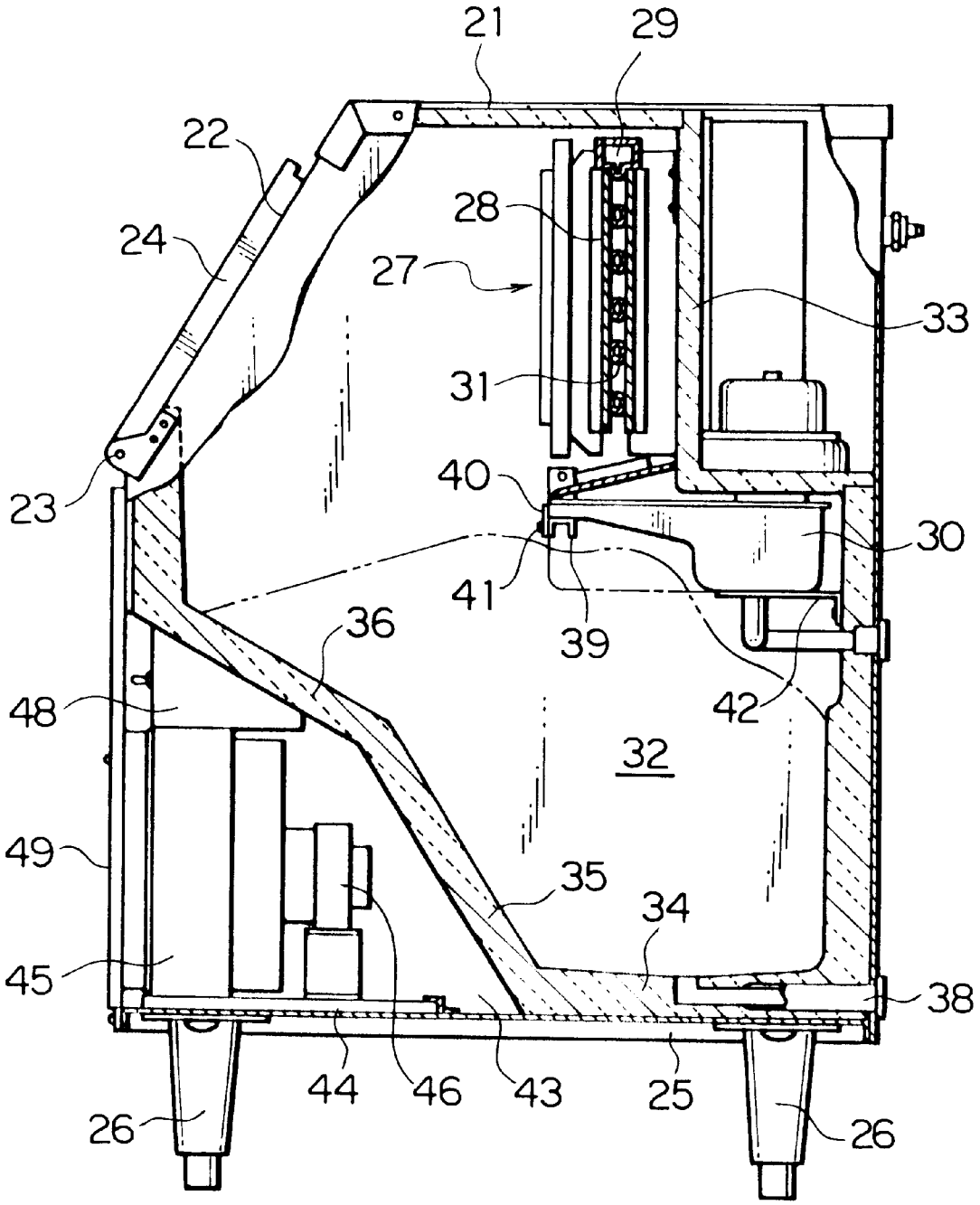
FIG. 1 is a cross-sectional side elevation of a flow-down ice maker according to an embodiment of the present invention.

A preferred embodiment of the present invention will now be explained using the attached drawings. FIG. 1 is a cross-section of a side elevation of a flow-down ice maker according to an embodiment of the present invention. The external case 21 is a stainless steel box which is provided with an opening port 22 for taking-out ice formed in the upper front portion thereof. The opening port 22 for taking-out ice is closably sealed by a lid 24 which is rotatably attached to the external case by means of metal hinges 23. The external case 21 is provided with a rectangular base plate 25, and a plurality of support legs 26 are disposed on the underside of the base plate 25.

Figure 2:
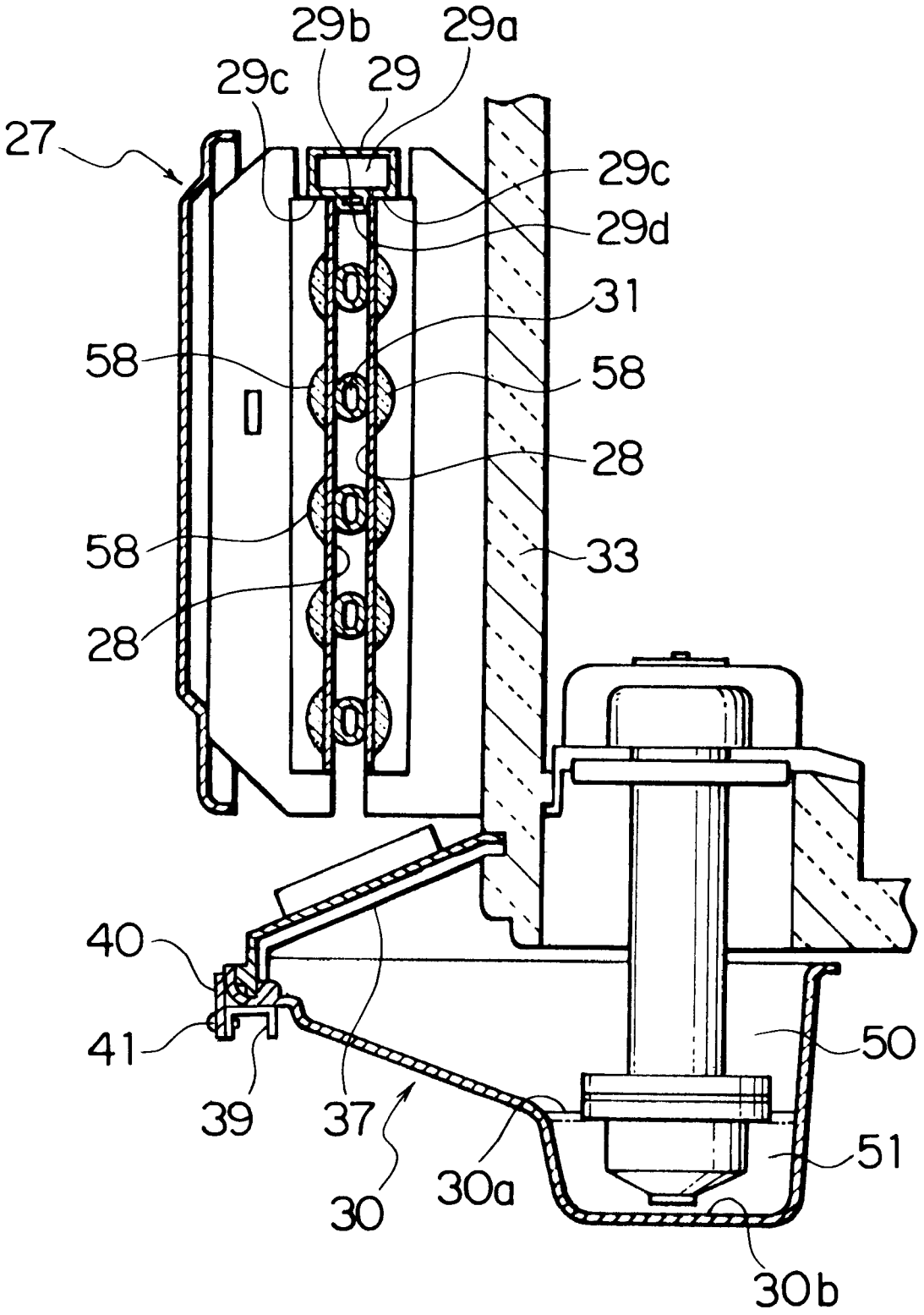
FIG. 2 is an enlarged sectional side elevation of the ice-making portion and the ice-making water tank in FIG. 1.

An ice-making portion component 27 is disposed in the upper portion within the external case 21. As shown in FIG. 2, the ice-making portion component 27 comprises: a pair of front and back ice-making plates 28; and a sprinkler 29, which is disposed at the top of these ice-making plates 28. The sprinkler 29 comprises: an ice-making water passage 29*a*; and an ice-removing water passage 29*b*, which is positioned between the pair of ice-making plates 28. Sprinkler holes 29*c* are disposed in the ice-making water passage 29*a*, so that ice-making water sprinkles onto the surface of each of the ice-making plates 28. Water supply holes 29*d*, which release ice-removing water between the pair of ice-making plates 28, are disposed in the ice-removing water passage 29*b*. The ice-removing water passage 29*b* is connected to a water source outside the ice maker by means of a water supply valve (not shown).

The pair of ice-making plates 28 are composed of stainless steel. Cooling tubes (evaporators) 31, which are composed of metal such as copper, etc., are disposed between the pair of ice-making plates 28. Moreover, if the thermal conductivity of the stainless steel is too high, there is a risk that transfer of heat to the coolant gas-will occur too quickly and too much ice will form and freeze together in the ice-making plates 28. Thus, suitable stainless steel is selected bearing this point in mind.

An ice-making water tank 30, which will be explained in detail below, is disposed generally below the ice-making plates 28. An ice guide plate 37 is disposed at an inclined angle between the ice-making plates 28 and the ice-making water tank 30. The upper edge of the ice guide plate 37 is inserted into the back wall 33 of an ice stocker 32 (see FIG. 1), which is composed of heat insulating material. The lower edge of the ice guide plate 37 is supported by a depression, which is formed in the front edge of the ice-making water tank 30. A plurality of water passage holes are disposed in the ice guide plate 37.

Returning to FIG. 1, the floor portion 34 of the ice stocker 32, which is composed of heat insulating material, is positioned on the back portion of the base plate 25 of the external case 21. The front wall portion of the ice stocker 32 comprises: a first wall portion 35, which extends obliquely upwards from the front edge of the floor portion 34; and a second wall portion 36, which extends upwards from the front edge of the first wall portion 35. A drainage outlet 38 is disposed in the floor portion 34 of the ice stocker 32.

A support member 39 with a U-shaped cross-section, which supports the front of the ice-making water tank 30, is disposed generally horizontally within the ice stocker 32 (see FIG. 2). The support member 39 is secured at both ends to the side walls of the ice stocker 32, and a plate-shaped tank bracket 40, which is secured to the front edge of the ice-making water tank 30, is detachably attached to the central portion of the front edge of this support member 39 by screws 41. A plate-shaped tank support 42, which supports the bottom of the ice-making water tank 30 from below, is attached to the back wall portion 33 on the inside of the ice stocker 32.

A machine chamber 43 is formed in front of the ice stocker 32. A plate-shaped unit base 44 is disposed on the floor of the machine chamber 43 so as to be slidable forwards and backwards with respect to the external case 21. A freezer unit, which includes a condenser 45, a condenser fan motor 46, a compressor 47 (see FIG. 3), etc., is mounted on the unit base 44, and this freezer unit is capable of being slid out of the machine chamber 43 by pulling the unit base 44 forwards. An electronics case 48, which houses the electronic components which drive the freezer unit, is disposed in the upper portion of the inside of the machine chamber 43. A front panel 49, which is provided with air vents, is removably disposed in front of the machine chamber 43.

Figure 3:
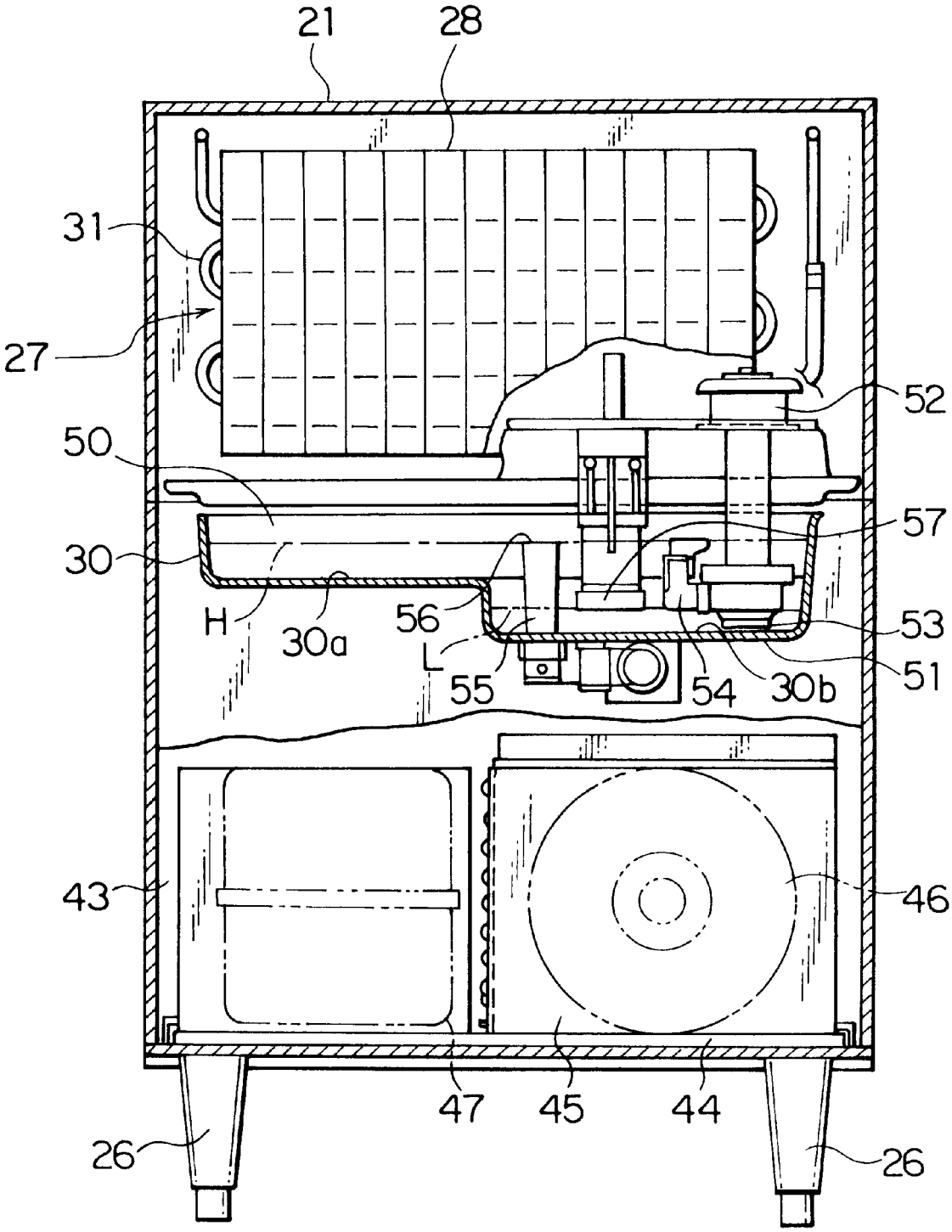
FIG. 3 is a front elevational view in section of a flow-down ice maker according to an embodiment of the present invention.

As shown in FIG. 3, the ice-making water tank 30 is provided with a main body 50 with a deep portion 51 formed in part of the main body 50. The deep portion 51 opens to a first bottom 30*a* in the main body 50 and is provided with a second bottom 30*b* which is formed lower than the first bottom 30*a*. The discharge inlet 56 of an overflow pipe 55 (a means for setting the upper limit of the water level in the ice-making water tank) is disposed in the central portion of the main body 50. The level of the ice-making water in the ice-making water tank 30 cannot rise higher than the discharge inlet 56 of the overflow pipe 55, and the position of the discharge outlet 56 is set at the upper limit H of the level of the ice-making water. The water intake 53 of a pump 52 is disposed in the deep portion 51. Ice-making water in the deep portion 51 is conveyed to the sprinkler 29 by the pump 52 through a water supply pipe 54.

The upper limit H of the water level in the ice-making water tank 30 is set so as to be above the first bottom 30*a*, and the lower limit L of the water level is set so as to be below the first bottom 30*a* (i.e., within the deep portion 51). Now, the overflow pipe 55 is disposed in the central portion of the water surface in the main body 50 (in this case the central portion of the main body 50) as a means for setting the upper limit of the water level in the ice-making water tank. A float switch 57 (a means for setting the lower limit of the water level in the ice-making water tank), which sets the lower limit L of the water level in the ice-making water tank, is disposed in the central portion of the water surface in the deep portion 51. Moreover, the float switch 57 may also be disposed in the geometrically central portion of the deep portion 51.

Figure 4A:
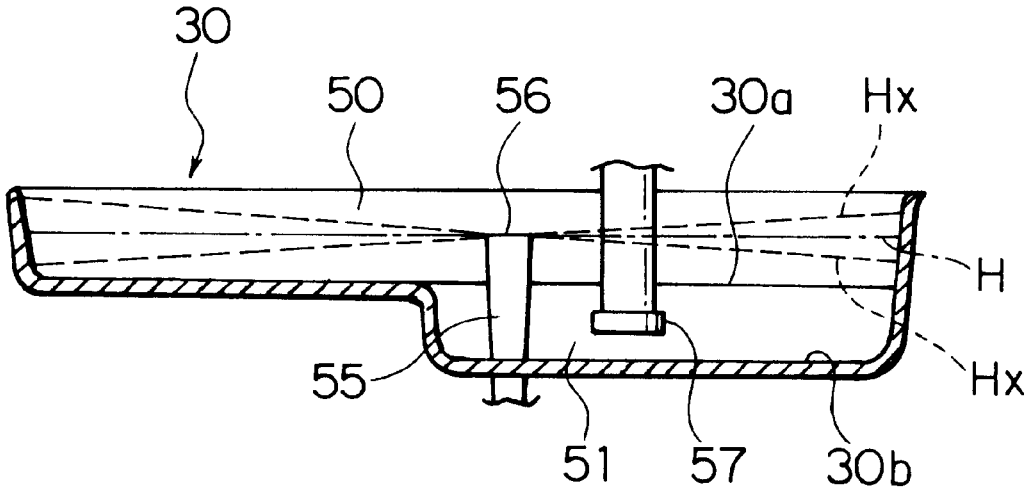
FIG. 4A is a sectional view of the ice-making water tank showing the upper limit of the water level when the ice-making water tank is inclined.
Figure 4B:
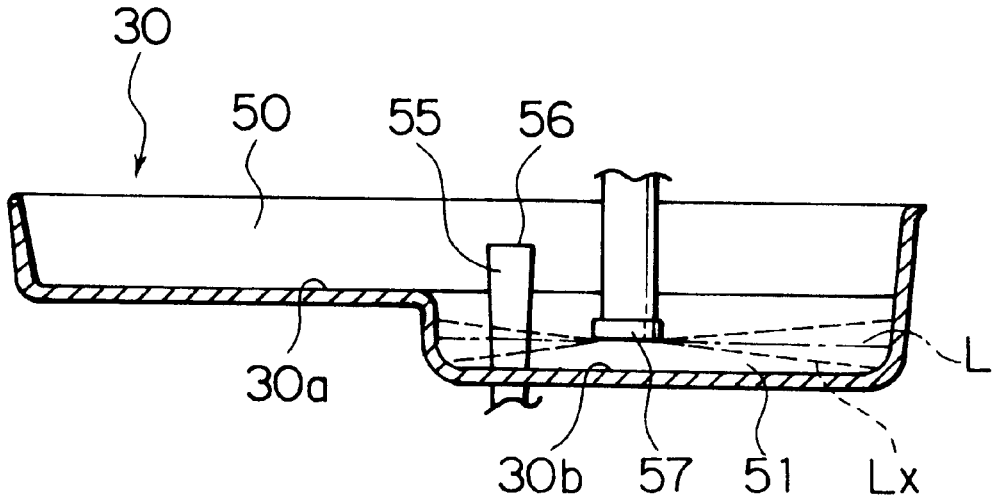
FIG. 4B is a cross-section of the ice-making water tank showing the lower limit of the water level when the ice-making water tank is inclined.
Figure 5:
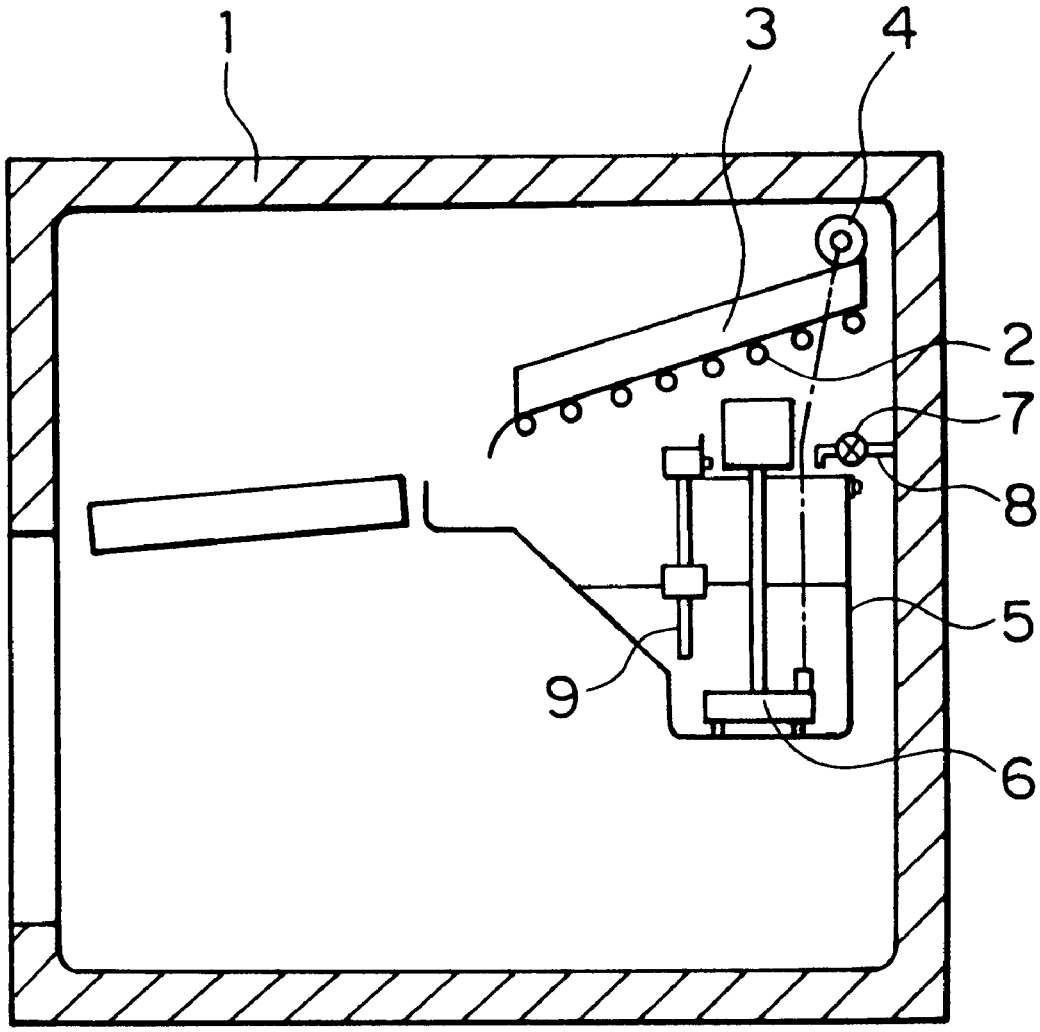
PRIOR ART FIG. 5
FIG. 5 is a diagram showing the internal construction of a conventional flow-down ice maker.
Figure 6A:
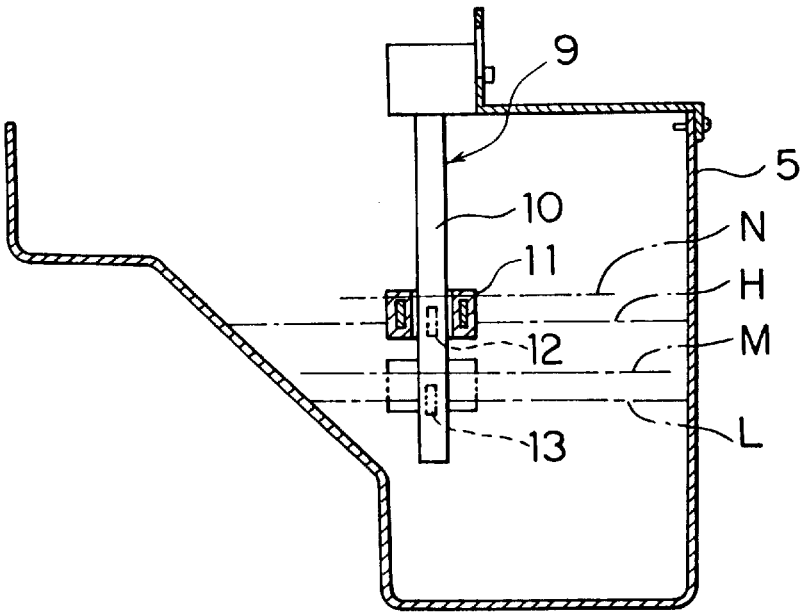
PRIOR ART FIG. 6A
FIG. 6A is a sectional view of conventional ice-making water tank when the ice-making water tank is horizontal.
Figure 6B:
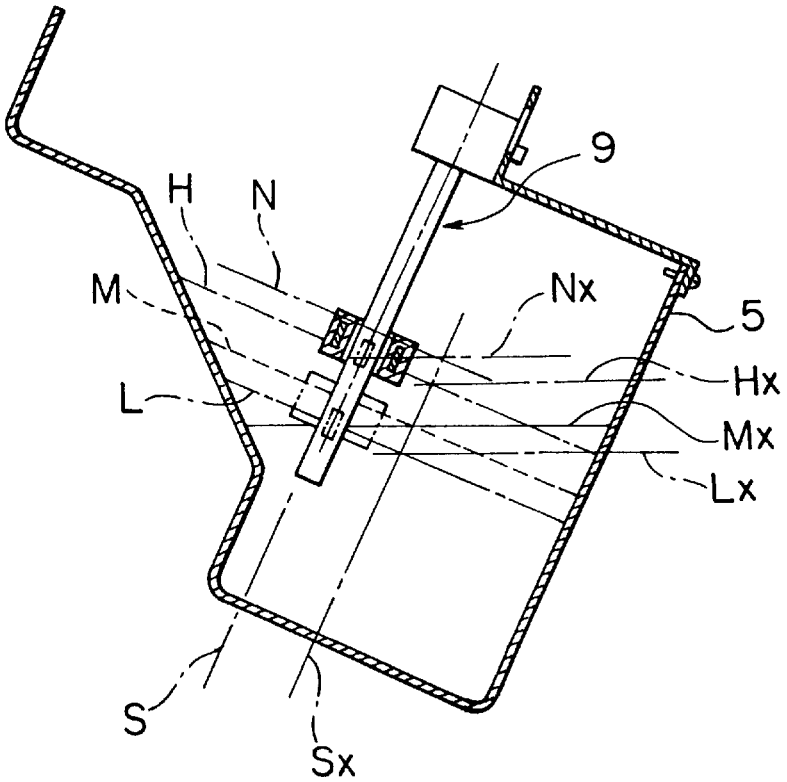
PRIOR ART FIG. 6B
FIG. 6B is a sectional view of conventional ice-making water tank when the ice-making water tank is inclined.

As a result, even if the surface of the ice-making water is inclined relative to the ice-making water tank 30 as shown by the broken lines in FIGS. 4A and 4B due to inclination of the ice-making water tank 30, the upper limit Hx and lower limit Lx of the water level, which are set by the overflow pipe 55 and the float switch 57, respectively, are practically equal to the prescribed upper limit H and lower limit L of the water level when the ice-making water tank 30 is horizontal.

In the flow-down ice maker explained above, the ice-making process is initiated when the water level in the ice-making water tank 30 reaches the upper limit H and ice-making water from the ice-making water tank 30 is conveyed by the pump 52 to the sprinkler 29. The ice-making water, which is sprinkled onto the ice-making plates 28 through the sprinkler holes 29*c* in the sprinkler 29, is cooled by the cooling tubes, so that ice 58 of generally crescent-shaped cross-section, as shown in FIG. 2, forms in the vicinity of the cooling tubes 31 on the ice-making plates 28. Ice-making water which does not freeze on the ice-making plates 28 flows down and drips off the lower edges of the ice-making plates 28 into the ice-making water tank 30. During this time, the water supply valve mentioned above remains closed and no new ice-making water is supplied, and the level of the ice-making water in the ice-making water tank 30 therefore decreases by an amount corresponding to the ice-making water which becomes ice. Then, when the level of the ice-making water in the ice-making water tank 30 reaches the lower limit L, the float switch 57 is activated, the pump 52 is stopped, and the ice-making process is terminated. Upon termination of the ice-making process, ice-making water remains in the ice-making water tank 30 up to the height of the lower limit L. However, in the present invention, the lateral cross-section of the deep portion 51, in which the lower limit L of the water level in the ice-making water tank 30 is set, is smaller than the lateral cross-section of the main body 50. Therefore the amount of water remaining can be reduced and, thus the volume of the ice-making water tank 30 can be reduced.

When the water supply and ice-removing processes subsequently begin, the water supply valve is opened and main supply water at room temperature is supplied as ice-removing water to the ice-removing water passage 29*b* in the sprinkler 29. The ice-removing water flows down between the pair of ice-making plates 28 and drips into the ice-making water tank 30. Hot gas is also passed through the cooling tubes 31. The generally crescent-shaped ice 58 is warmed by the ice-removing water and the hot gas and the surface of the ice which is frozen to the ice-making plates 28 melts, and the ice is freed and falls under its own weight.

At this point, if the ice maker is inclined and, as in a conventional example, the upper limit Hx of the water level in the ice-making water tank is set higher than the prescribed upper limit H, or the lower limit Lx of the water level in the ice-making water tank is set lower than the prescribed lower limit L, the amount of water used to make ice will increase. The size of the ice formed will be that much larger, and there is a risk the ice will join together, making ice-removal difficult. However, in the present embodiment, even if the water in the ice-making water tank is inclined, the upper limit Hx and the lower limit Lx of the water level in the ice-making water tank are set so that they practically do not change from the prescribed water level limits H, L. Thus the conventional ice removal difficulties due to the ice joining together do not-arise, and there is no inconsistency in the size of the ice.

The ice which is removed from the ice-making plates 28 in the manner described above falls onto the ice guide plate 37, which has an inclined surface, is guided by the ice guide plate 37 and is progressively stored in the ice stocker 32. The stored ice piles up to the vicinity of the bottom of the ice-making water tank 30, as indicated by the double-dot-and-dash line in FIG. 1. In the present embodiment, the deep portion 51 is formed only in the back portion of the ice-making water tank 30. Therefore the amount of ice which can be stored is increased in comparison to when the ice-making water tank is shaped like a box, as indicated by the dot-and-dash line in the drawing.

Moreover, the present invention is not limited to the above embodiment and can be modified and constructed in the following manner, for examples.

In the above embodiment, an overflow pipe 55 is used to set the upper limit of the water level in the ice-making water tank, but a water level sensor, such as a float switch, etc., may be used instead. That is, the water sensor may be set so that it is activated to close the water supply valve and stop the supply of water when the level of the ice-making water in the ice-making water tank 30 reaches the upper limit.

As explained above, according to the flow-down ice maker of the present invention, the upper limit and lower limit of the water level in the ice-making water tank when the ice-making water tank 30 is inclined is almost equal to the normal upper limit and lower limit of the water level when the ice-making water tank 30 is horizontal. Therefore, inconsistencies in the amount of ice produced in one cycle and in the size of the ice produced can be prevented.

What is claimed is:

1. A flow-down ice maker comprising:

an ice-making component including plates and an evaporator for cooling said plates;

a sprinkler for sprinkling ice-making water over said plates;

an ice-making water tank for storing the ice-making water, said tank including a main body comprising a shallow portion and a deep portion, said shallow portion having a first bottom, and said deep portion having a second bottom positioned lower than said first bottom;

a pump for conveying the ice-making water from said tank to said sprinkler, said pump having a water intake part arranged in said deep portion of said tank;

a water level upper limit setting device for setting a prescribed upper limit of the ice-making water level in said tank, said upper limit setting device being arranged in a central location of said main body of said tank; and a water level lower limit setting device for setting a prescribed lower limit of the ice-making water level in said tank, said lower limit setting device being arranged in a central location of said deep portion of said main body of said tank.

2. The ice maker of claim 1, wherein said first bottom and said second bottom are substantially parallel and non-coplanar.

3. The ice maker of claim 1, wherein said water level upper limit setting device comprises an overflow pipe having an overflow inlet, said overflow pipe being arranged such that said overflow inlet faces upward at said central location of said main body portion of said tank.

* * * * *